US005964956A

United States Patent [19]

Straub et al.

[11] Patent Number: 5,964,956

[45] Date of Patent: Oct. 12, 1999

[54] PROCESS FOR CLEANING A TRANSPORT BELT

[75] Inventors: Karlheinz Straub, Heidenheim; Markus Oechsle, Bartholmae; Gerhard Kotitschke, Steinheim, all of Germany

[73] Assignee: Voith Sulzer Papiermaschinen GmbH, Heidenheim, Germany

[21] Appl. No.: 09/103,378

[22] Filed: Jun. 24, 1998

[30] Foreign Application Priority Data

Jun. 25, 1997 [DE] Germany ..... 197 26 897

[51] Int. Cl.[6] ..... B08B 1/02; B08B 3/02; B08B 5/00; B08B 5/04

[52] U.S. Cl. ..... 134/15; 134/18; 134/21; 134/32; 134/37; 134/64 R; 15/302; 15/309.1

[58] Field of Search ..... 134/15, 18, 21, 134/32, 37, 64 R; 15/302, 309.1

[56] References Cited

U.S. PATENT DOCUMENTS 4,378,639 4/1983 Walker ..... 134/15

5,783,044 7/1998 Schneider et al. ..... 162/278

FOREIGN PATENT DOCUMENTS

| | | |
|---|---|---|
| 1143982 | 4/1983 | Canada . |
| 024205 | 2/1981 | European Pat. Off. . |
| 383486 | 8/1990 | European Pat. Off. . |
| 3234885 | 10/1991 | Japan . |
| 2230620 | 10/1990 | United Kingdom . |
| 9626317 | 8/1996 | WIPO . |

OTHER PUBLICATIONS

English Language Abstract of JP–3–234885.

*Primary Examiner*—Zeinab El-Arini
*Attorney, Agent, or Firm*—Greenblum & Bernstein P.L.C.

[57] ABSTRACT

A process for cleaning a transport belt of a machine to manufacture a material web, in particular a paper or cardboard web, is provided so that the transport belt is cleaned with varying intensity across its width.

26 Claims, 1 Drawing Sheet

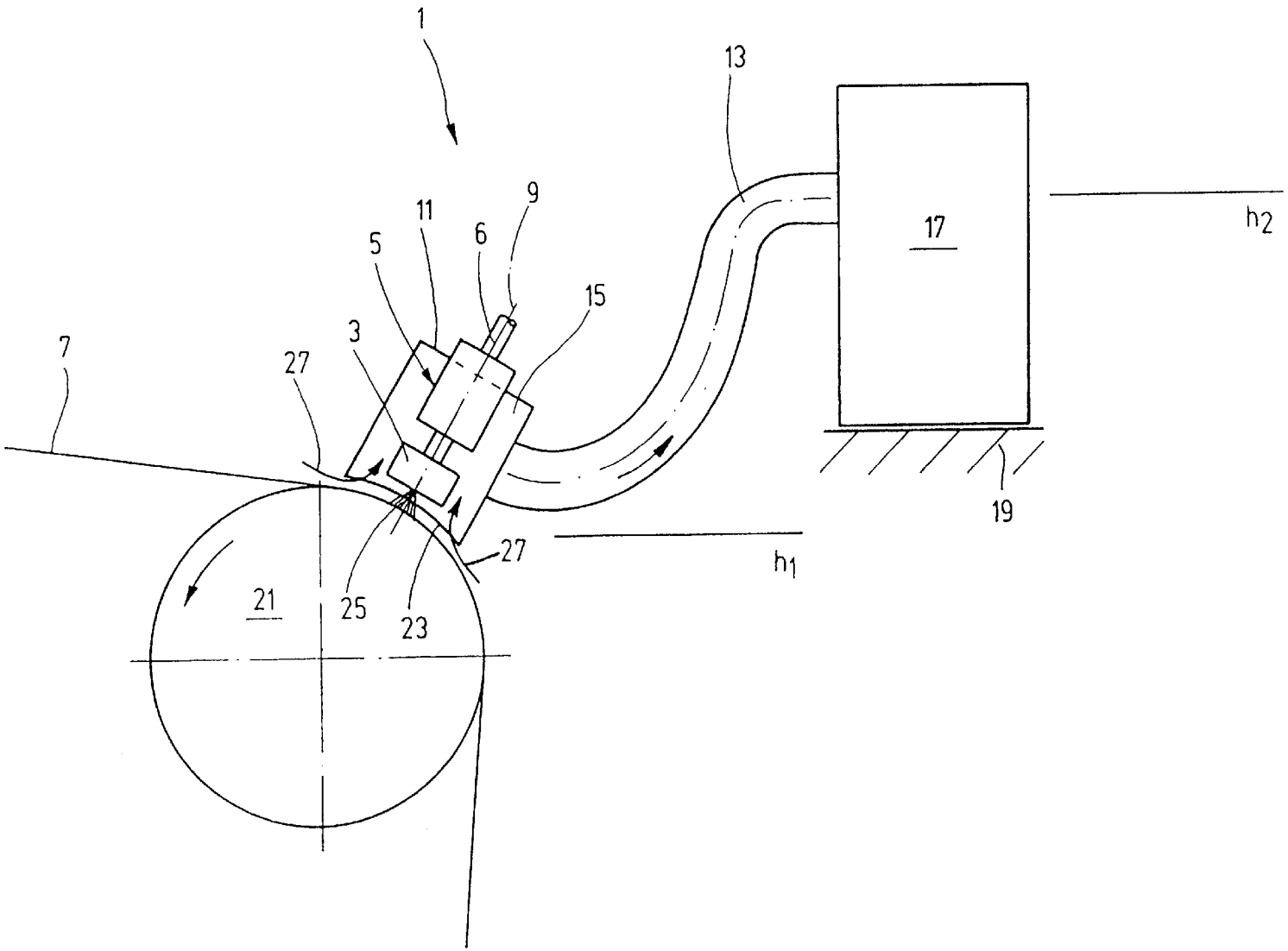
h2
17
19
13
h1
15
9
6
1
11
5
3
27
27
23
25
21
7

PROCESS FOR CLEANING A TRANSPORT BELT

CROSS REFERENCE TO RELATED APPLICATION

The present application claims the priority under 35 U.S.C. §119 of German Patent Application No. 197 26 897.8 filed on Jun. 25, 1997, the disclosure of which is expressly incorporated by reference herein in its entirety.

BACKGROUND OF THE INVENTION

1. Field of the Invention

The invention relates to a process for cleaning a transport belt of a machine to manufacture a material web, in particular a paper or cardboard web, and a device for cleaning a transport belt of a machine to manufacture a material web.

2. Discussion of Background Information

Numerous transport belts, in particular fiber web belts, are used in machines to manufacture a material web. These belts are contaminated during the operation of the machine, for example by the fibers of the material web, adhesives, or other aggregates that clog the pores of the mesh and pores of the transport belt. The transport belts are cleaned with the aid of a cleaning device in order to ensure an uninterrupted production sequence. Cleaning devices are known that consist of a nozzle that can be actuated using a pressurized cleaning material. The nozzle is able to be placed perpendicular to the run direction of the transport belt and applies the cleaning material evenly to the transport belt surface. Furthermore, cleaning devices are known that consist of a nozzle cross-rail, running perpendicular to the run direction of the transport belt, on which several nozzles are mounted, so that a cleaning material can be applied to the transport belt. It has been demonstrated that the transport belts, viewed perpendicular to the run direction, are highly contaminated in an uneven manner, i.e. the transport belt can, for example, be contaminated to a particularly high degree along the edge sections, while only slight contamination occurs in the center of the transport belt. The even cleaning effect of the known cleaning devices can not achieve satisfactory cleaning results in such cases, leading to interruptions of the production sequence and, in particular, to sacrifices in the quality of the product.

It is therefore the task of the invention to create a process and a device that does not exhibit the foregoing disadvantages.

SUMMARY OF THE INVENTION

To solve these problems a process is proposed that differentiates from other cleaning processes and devices in that the transport belt is cleaned with varying intensity across the transport belt width. During a cleaning process, the transport belt, viewed perpendicular to the run direction of the transport belt, is cleaned in different sections, each with a specific cleaning intensity that is preferably adjusted to the degree of contamination on the respective transport belt section. However, it is also possible that the edges of the transport belt are categorically cleaned with a higher intensity than the transport belt section lying between the edges or the other way around. By cleaning the transport belt with varying intensities, particularly good cleaning results can be achieved, so that an interruption of the production sequence, due to insufficient thoroughness in the cleaning of the transport belt, can practically be eliminated. The amount of cleaning material that was previously required in the cleaning process can also be reduced.

An embodiment of the process is preferred wherein the transport belt is cleaned with a gaseous or liquid pressurized cleaning material, and wherein the cleaning intensity can be adjusted by controlling the pressure of the cleaning material. The higher the pressure of the cleaning material, the higher the cleaning effect, and the other way around. Thus, only slightly contaminated transport belt sections can be sprayed with a cleaning material that is under a lower pressure and the more contaminated transport belt sections can be sprayed with a cleaning material that is under a correspondingly higher pressure. By using low pressure, the transport belt is subjected to relatively low stress, which extends the life span of the transport belt, in particular for sensitive or fragile transport belts.

Particularly preferred is an embodiment of the process, wherein the cleaning intensity can be adjusted by specifically pre-setting the period of time during which a specific area of the transport belt is to be cleaned. In another embodiment of the invention, provisions are made, wherein the cleaning intensity can be influenced by adjusting the time intervals between two sequentially arranged cleaning processes in which the same area of the transport belt is to be cleaned. The cleaning intensity increases with a longer cleaning period and/or a shorter time interval between two cleaning processes.

Particularly preferred is an embodiment of the process, wherein the cleaning area of the transport belt is put under a partial vacuum and the pressure, i.e., vacuum, is controlled depending on the desired cleaning intensity. With increasing vacuum even dirt that exhibits very tough adhesive properties can be removed safely so that the desired cleaning results can be achieved. Particularly advantageous in controlling the vacuum is that the vacuum level, and therefore the costs for producing the vacuum, can be reduced.

An embodiment of the process is preferred, wherein the cleaning material volume to be applied to the transport belt to be cleaned can be adjusted. The cleaning effect can thereby increase with an increasing amount of cleaning material applied to the transport belt. The amount of cleaning material required for a thorough cleaning can be reduced by determining the amount of the liquid or gaseous cleaning material to be used for the cleaning of the transport belt, for example, depending on the degree of contamination of the transport belt section to be cleaned.

The process of the invention can also be used to control the moisture profile of the transport belt. Because the transport belt, viewed perpendicular to the run direction, is cleaned with varying intensity depending on the section/area, the moisture content of the transport belt can be influenced and preferably adjusted. The moisture profile of the material web, supported by the transport belt after the cleaning process, can thereby be influenced and can also preferably be adjusted. The adjustment of the moisture profile, i.e. the water content of the transport belt/material web, viewed perpendicular to its run direction, can, for example, occur in accordance with a pre-set, specified profile, whereby the intensity of the transport belt cleaning is adjusted accordingly.

To solve the aforementioned task, a device is also proposed which includes a nozzle device containing at least one jet, with which the transport belt is sprayed with the pressurized cleaning material. The cleaning device, including the nozzle device, is constructed in such a fashion that the transport belt, viewed along the width of the belt, is cleaned with a variable or varying intensity. A good cleaning result can thereby be ensured and the usage of cleaning material for cleaning the transport belt can be kept relatively low, preferably minimized, at the same time.

In a particularly preferred embodiment of the cleaning device, provisions are made to control the pressure of the cleaning material depending on the desired cleaning intensity. Because the pressure of the cleaning material is lower, for example for a low cleaning intensity, than the pressure or pressure ranges required for an intensive cleaning, it is possible to reduce the stress on the transport belt at least in sections. It is furthermore possible to reduce the operating costs of the cleaning device.

An embodiment of the cleaning device is preferred, wherein a nozzle device is positioned such that it can traverse perpendicular to the run direction of the transport belt, and wherein the traversing speed can be adjusted to influence the cleaning intensity. The sections of the transport belt that are to be cleaned with a relatively low intensity are, for example, covered or passed over more quickly by the nozzle device than sections that are to be subjected to a more intensive cleaning.

In addition, an embodiment of the cleaning device is proposed, wherein the pressure of the cleaning material can be adjusted with the aid of a control system and/or regulator unit that controls/regulates the number of rotations of a pump that supplies the nozzle device with the cleaning material. The control system, such as a stored program system (SPS), allows the cleaning intensity of the transport belt, or at least a transport belt section, to be adjusted automatically.

Preferred also is an embodiment of a cleaning device, wherein a vacuum chamber is provided that acts together with the nozzle device and that is connected to a vacuum unit via a vacuum line, and wherein the vacuum output of the vacuum unit can be controlled in relation to the desired cleaning intensity. Herein, use of the term vacuum output means the volume of intake air from a cleaning section during a specified period of time. The operating costs of the cleaning device can be reduced due to these measures. In an advantageous embodiment of the device, it is possible that the vacuum output can be adjusted in an infinitely variable manner with the aid of a valve, for example, placed in the vacuum line.

BRIEF DESCRIPTION OF THE DRAWING

The present invention is further described in the detailed description which follows, in reference to the noted drawing by way of non-limiting examples of preferred embodiments of the present invention, wherein the same reference numerals represent the same parts throughout the view of the drawing, and wherein:

The FIGURE shows a schematic side view of a device for cleaning a transport belt of a machine to manufacture a material web which is not shown therein.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing making apparent to those skilled in the art how several forms of the invention may be embodied in practice.

The cleaning device 1 can be used for any transport belt of machines that manufacture a material web, for example for sieve belts or felts of sieve sections, press sections or drying sections of a paper or cardboard manufacturing machine. The term "transport belts" also refers to sieves or felts that are used in formers preceding the press section or drying section. It is assumed purely for the sake of example that transport belts of a paper machine are used.

The cleaning device 1 includes a nozzle device 5 having a nozzle head 3. The nozzle head 3 includes at least one jet—not illustrated here—that applies a liquid cleaning material, such as water, or gaseous cleaning material, such as steam, to a porous transport belt 7. It is assumed purely for the sake of example in the following that a liquid cleaning material that is pressurized at 100 bar to 1000 bar is utilized. In addition, a connector 6, partially illustrated in the figure, is provided to which a pressure hose, able to be coupled to a pump, can be connected in order to supply the nozzle device 5 with cleaning material.

In another embodiment, the nozzle head 3 can be constructed so that it can rotate around its longitudinal axis 9 and is provided with a nozzle arrangement that contains one or more driving jets, from which the cleaning material is ejected or sprayed tangential to the transport belt surface and which serve to create a rotational motion. One or more cleaning jets are also included that apply the cleaning material to the transport belt. However, the rotation of the nozzle head can also be achieved in another manner that does not involve the use of driving jets.

The nozzle arrangement 5 is completely surrounded by a jacket-shaped vacuum box 11. The interior of the vacuum box 11 is connected to a vacuum line 13 and makes up the vacuum chamber 15 which operates in conjunction with the nozzle device 5. The vacuum line 13 is mounted on a traversing wagon 17 and is connected to a vacuum source which is not illustrated here. The traversing wagon 17 can be positioned along cross-rail 19 which extends perpendicular to the run direction of the transport belt 7 and is illustrated in a highly schematic manner. The traversing wagon 17 and the cross-rail 19 make up the traversing unit 20.

As illustrated in the figure, the cleaning device 1 is positioned adjacent to a deflection roller 21, around which the transport belt 7 is guided. The vacuum box 11, extending over a portion of the circumference of the deflection roller 21, is disposed at a distance from the deflection roller 21. An end section 23 of the vacuum box 11, facing the transport belt 7, is fit to the shape of the circular-cylindrical circumference of the guide roller 21 so that the gap between the vacuum box 11 and the transport belt 7 is essentially even. The distance between the vacuum box 11 and the transport belt 7 can be adjusted, which will be explained in more detail later.

The functions of the cleaning device 1 will be explained in more detail below. The transport belt 7, guided over the deflection roller 21, is sprayed with pressurized cleaning solution (jet stream 25) with the aid of the nozzle device 5. The large particles and dirt are thereby dissolved from the transport belt 7 and removed from the surface of the transport belt 7 through the vacuum box 11. So-called inleaked air from the atmosphere is specifically drawn into the vacuum chamber 15 through the defined gap between the vacuum box 11 and the transport belt 7, while also drawing in the dirt and cleaning solution. These particles are again carried away via the vacuum line 13 from the vacuum chamber 15. The flow created by the suction of the inleaking air is indicated with the arrows 27. By adjusting the distance between the vacuum box 11 and the transport belt 7, the flow can be changed in a targeted fashion. Because a specific air flow from the surroundings is allowed into the vacuum chamber 15, a drainage line (not illustrated and the discharge point of the vacuum line 13) that is mounted on the traverse wagon 17 can be arranged on a higher level H2 than the nozzle device 5 which is arranged at a level indicated by H1. As a result, universal insertion positions of the traversing unit 20, constructed of the traversing wagon 17 and the traverse cross-rail 19, are made possible so that a compact construction of the machine can be realized in an advantageous manner.

The transport belt 7 can be cleaned with varying or variable intensity level across its width with the aid of the cleaning device 1 illustrated in the figure including the traversable nozzle device 5. The pressure of the cleaning material, here cleaning solution, can be adjusted for this purpose depending on the desired cleaning intensity. The pressure adjustment/control of the cleaning solution can, for example, be performed by a control unit/regulator system (not illustrated) which controls the flow rate of the pump that supplies the nozzle device 5 with cleaning material. The effect of the jet stream 25, and thus the cleaning intensity, is reduced with a lower pressure. The cleaning intensity is increased with increasing pressure in a correlative manner.

The intensity of the transport belt 7 cleaning can also be influenced by varying the traversing speed of the nozzle device 5 which, preferably, can be adjusted. The retention time of the jet stream 25 on the same section of the transport belt 7 is reduced with high traversing speed, meaning that a lower cleaning effect occurs at a higher speeds than at a lower speeds. In another embodiment, provisions are made that influence the cleaning intensity, the pressure of the cleaning solution, as well as the traversing speed.

Another possibility of adjusting the cleaning effect of the cleaning device 1 includes varying the vacuum output of the vacuum unit, for example by installing a valve in the vacuum line 13, by means of which the volume that is being vacuumed from the vacuum chamber 15 is adjustable. The valve, not shown in the figure, can, for example, be constructed as a relief valve which can be controlled in an infinitely variable manner. In order to increase the cleaning effect, additional cleaning jets can be provided that can be independently activated and deactivated so that, depending on the demand, one or more of the additional jets can be turned on/off before or during the cleaning process.

It becomes clear that any one of the aforementioned possibilities to influence the cleaning intensity of the cleaning device 1 can be used by itself, or that several of the described methods and structures can be used at the same time in order to achieve the desired results. One can thereby, depending on the degree of contamination of the transport belt 7—viewed across its width—adjust the effect of the cleaning device 1, i.e. the intensity with which the transport belt is to be cleaned. A reduction in the demand for the cleaning material and/or the vacuum demand with respect to conventional cleaning devices is thus possible.

The process mentioned above is clearly extrapolated from the description of the figure and includes cleaning a transport belt with varying intensity across its width.

The process in accordance with the invention can furthermore be used to adjust the moisture profile of the transport belt 7. By synchronizing the traversing speed, the pressure of the cleaning material, the duration of cleaning, the duration of the time intervals lying between two sequential cleaning processes, actuating additional cleaning jets, and/or by controlling/regulating the vacuum output of the vacuum device, it is possible to determine an exact water content in the transport belt 7 across its width. It is, however, possible thereby to control the moisture profile of the material web which is adjusted with the assistance of appropriate devices and which is supervised by means of cross-sectional profile measuring equipment. The adjustment of the moisture profile of a transport belt, such as a press felt or a press section, can ensue manually or automatically, preferably following a pre-set profile, through control/regulation of the cleaning intensity.

The intensity, with which the transport belt 7 is cleaned in certain areas, is preferably dependent upon the degree of the contamination. It has been observed that often the edges of the transport belt 7 are contaminated much more than the transport belt segment lying in-between, so that these must be cleaned at a higher intensity. This can be accomplished with one of the measures described above.

It must be concluded that by cleaning the transport belt 7 across its width at varying intensities, the operational costs of the cleaning device 1 and thus the machine to manufacture a material web can be reduced while simultaneously preserving a good cleaning result.

It is noted that the foregoing examples had been provided merely for the purpose of explanation and are in no way to be construed as limiting of the present invention. While the invention has been described with reference to preferred embodiments, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed:

1. A process for cleaning a transport belt of a machine to manufacture a material web, comprising:

cleaning the transport belt across a total width of the transport belt;

varying intensity of the cleaning over the total width of the transport belt; and adjusting a time interval between two sequential cleaning processes which sequentially clean a substantially same section of the transport belt.

2. The process in accordance with claim 1, further comprising:

cleaning the transport belt with a pressurized cleaning material provided in one of a gaseous and liquid form; and, adjusting pressure of the cleaning material by one of a control system and regulator unit so as to vary the cleaning intensity.

3. The process in accordance with claim 2, further comprising:

specifying a time period during which a specified portion of the transport belt is to be cleaned.

4. The process in accordance with claim 3, further comprising:

subjecting a section of the transport belt to be cleaned to vacuum; and, adjusting a level of the vacuum to vary with a desired degree of cleaning.

5. The process in accordance with claim 3, further comprising:

cleaning edges of the transport belt with a higher level of cleaning intensity than a level of cleaning intensity in sections of the transport belt located between the edges.

6. The process in accordance with claim 2, further comprising:

adjusting a moisture profile of the transport belt by cleaning the transport belt.

7. The process in accordance with claim 1, further comprising:

specifying a time period during which a specified portion of the transport belt is to be cleaned.

8. The process in accordance with claim 7, further comprising:

subjecting a section of the transport belt to be cleaned to vacuum; and, adjusting a level of the vacuum to vary with a desired degree of cleaning.

9. The process in accordance with claim 7, further comprising: controlling an amount of cleaning material applied to the transport belt.

10. The process in accordance with claim 1, further comprising: decreasing the time interval so as to intensify the cleaning process.

11. The process in accordance with claim 1, further comprising:

subjecting a section of the transport belt to be cleaned to vacuum; and, adjusting a level of the vacuum to vary with a desired degree of cleaning.

12. The process in accordance with claim 11, further comprising: controlling an amount of cleaning material applied to the transport belt.

13. The process in accordance with claim 11, further comprising:

cleaning edges of the transport belt with a higher level of cleaning intensity than a level of cleaning intensity in sections of the transport belt located between the edges.

14. The process in accordance with claim 1, further comprising: controlling an amount of cleaning material applied to the transport belt.

15. The process in accordance with claim 1, further comprising: adjusting a moisture profile of the transport belt by cleaning the transport belt.

16. The process in accordance with claim 1, wherein the material web is a paper web.

17. The process in accordance with claim 1, wherein the material web is a cardboard web.

18. A process for cleaning a transport belt of a machine to manufacture a material web, comprising:

cleaning the transport belt across a total width of the transport belt;

varying intensity of the cleaning over the total width of the transport belt; and cleaning edges of the transport belt with a higher level of cleaning intensity than a level of cleaning intensity in sections of the transport belt located between the edges.

19. The process in accordance with claim 18, further comprising:

adjusting a moisture profile of the transport belt by cleaning the transport belt.

20. The process in accordance with claim 18, further comprising:

cleaning the transport belt with a pressurized cleaning material provided in one of a gaseous and liquid form; and adjusting pressure of the cleaning material by one of a control system and regulator unit so as to vary the cleaning intensity.

21. The process in accordance with claim 20, further comprising:

specifying a time period during which a specified portion of the transport belt is to be cleaned.

22. The process in accordance with claim 21, further comprising:

adjusting a time interval between two sequential cleaning processes which sequentially clean a substantially same section of the transport belt.

23. The process in accordance with claim 18, further comprising:

specifying a time period during which a specified portion of the transport belt is to be cleaned.

24. The process in accordance with claim 23, further comprising:

adjusting a time interval between two sequential cleaning processes which sequentially clean a substantially same section of the transport belt.

25. The process in accordance with claim 18, further comprising:

adjusting a time interval between two sequential cleaning processes which sequentially clean a substantially same section of the transport belt.

26. The process in accordance with claim 25, further comprising:

cleaning the transport belt with a pressurized cleaning material provided in one of a gaseous and liquid form; and adjusting pressure of the cleaning material by one of a control system and regulator unit so as to vary the cleaning intensity.

* * * * *